United States Patent [19]

Biedess

[11] Patent Number: 4,947,765

[45] Date of Patent: Aug. 14, 1990

[54] SECURITY APPARATUS AND METHOD OF USING SAME

[75] Inventor: Frederick F. Biedess, Hickory Hills, Ill.

[73] Assignee: National Bulletproof, Inc., Hickory Hills, Ill.

[21] Appl. No.: 343,007

[22] Filed: Apr. 25, 1989

[51] Int. Cl.[5] ..... E05G 3/00

[52] U.S. Cl. ..... 109/6; 109/7; 109/8

[58] Field of Search ..... 109/2–8, 109/59 T

[56] References Cited

U.S. PATENT DOCUMENTS

| | | | |
|---|---|---|---|
| 1,915,735 | 6/1933 | Helms | 109/7 |
| 3,750,158 | 7/1973 | Anastassakis | 109/7 X |
| 3,844,232 | 10/1974 | Robinson | 109/7 |
| 4,060,039 | 11/1977 | Lagarrigue | 109/3 |
| 4,063,519 | 12/1977 | Pretini | 109/8 |
| 4,308,803 | 1/1982 | Pretini | 109/3 |
| 4,475,465 | 10/1984 | Hastings | 109/6 X |
| 4,586,441 | 5/1986 | Zekich | 109/6 X |
| 4,643,106 | 2/1987 | Aragona | 109/6 |
| 4,656,954 | 4/1987 | Tonali | 109/6 |

*Primary Examiner*—Robert L. Wolfe
*Assistant Examiner*—Suzanne L. Dino
*Attorney, Agent, or Firm*—Bernard L. Kleinke; William P. Waters; Jerry R. Potts

[57] ABSTRACT

The security method and apparatus relates to an electronically controlled latching mechanism which is adapted for use with a closure disposed on a vestibule. The closure is used to seal or close off a passageway or entrance between the vestibule and a protected or secured area. A security unit generates a signal which drives the latching mechanism from a latched to an unlatched position whenever an access control circuit generates an enablement signal. The enablement signal is generated whenever the vestibule is sealed and the weight of the person or persons within the vestibule, as determined by an electronic scale, compares with a predetermined weight value. A closure switch senses when the vestibule is closed, and a weight sensing mechanism senses the weight of a person or person disposed within the vestibule.

8 Claims, 6 Drawing Sheets

WEIGHT SENSORS
26
25

26A
19
22
ELECTRONIC SCALE
53
22A
POWER
53A
31A
31
31C
41
54A
+
COMP.
-
42
41A
51A
31B
30 SEC. DELAY
52
23
42A
33
23B
51
45B
24B
44
45
42
47
27A
46
24
24A
S
DRIVER
LATCH
FLIP FLOP
42A
24C
45A
44B
44A
43
27B
49
R
48
DRIVER
49A
43A
UNLATCH
47A

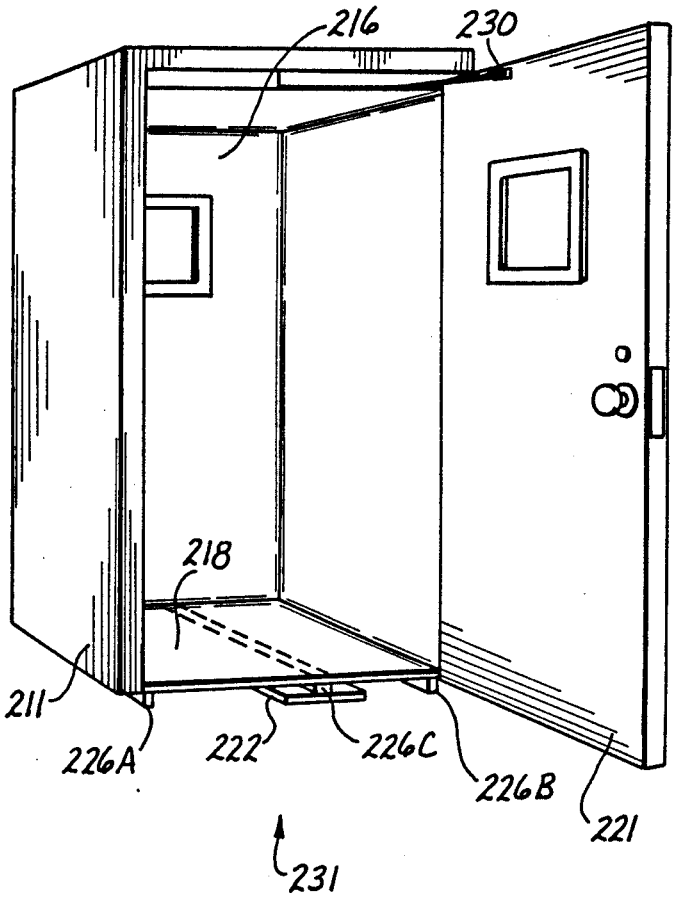
FIG. 3
FIG. 3B
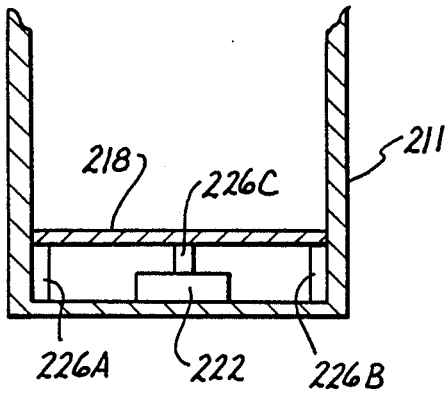

SECURITY APPARATUS AND METHOD OF USING SAME

TECHNICAL FIELD

This invention relates to the general field of security systems for controlling entry to a security area. More particularly, the present invention relates to a security system for use with a single or double door security room and a method for using the same to prevent unauthorized access to protected areas and the like.

BACKGROUND ART

There have been many different types and kinds of security systems and methods for using them relating to the controlling of access to a secured or protected area.

Conventional security systems of the general type with which the present invention is concerned are employed for controlling access to security or protected areas in which only authorized personnel are permitted to enter. The conventional, prior known, entry security systems include a single door security system, as well as a double door security system. With respect to the double door system, an authorized person unlocks a secured door and enters a vestibule or semi-secure area, and then closes and locks the secured door. The authorized person unlocks a second door and proceeds into the protected or secured area.

While the double door security system may have been successful in some applications, it has proved to be less than satisfactory in that a determined intruder with a gun or other life threatening weapon could lay in wait and compel the authorized person to unlock the secured door, enter the semi-secure area with the authorized person and then further compel the authorized person to unlock the second door to obtain access to the protected or secured area. Thus, the only determining factor in preventing the intruder from entering the secured area, is the willingness of the authorized person to risk bodily harm or death in refusing to unlock the doors to gain entry into the protected or secured area. Moreover, because the intruder can force the authorized person into the secured area, there is a present danger that the intruder will harm the authorized person in the secured area, once access has been achieved.

In an attempt to overcome the above-mentioned problems, the single door system with a small vestibule area has been employed.

With respect to the single door type systems, an authorized person can unlock a door which may then be swung open to a fixed point position to close off an entranceway to a secured area or room. Once the door reaches the fixed point position, it is automatically locked, and the authorized person is permitted to enter into a small, confined vestibule area formed by the ceiling, floor, walls and the door. By design, this area is only large enough to allow one person to fit comfortably therewithin. Once the authorized person has entered the area, he or she may unlock the door from its fixed position and thus, allowing the door to close to its original position When the door reaches its original position, it once again locks. The authorized person may then walk out of the vestibule area through the entranceway, which was previously blocked by the door in its fixed point position, and into the secured or protected area.

While the single door security system may have been successful for some applications, it too has not proved to be entirely satisfactory for all applications. Due to construction considerations, the size of the vestibule area should be sufficiently large to permit a large person to enter through it. Accordingly, if an authorized person has a small or medium size build, then a determined intruder with a small build can fit into the small vestibule area along with the authorized person and thus gain access into the secured or protected area, under threat of bodily harm with the authorized person.

Therefore, it would be highly desirable to have a security system which would prevent, or at least greatly reduce, the possibility of an unauthorized person following the authorized person, into the secured or protected area.

DISCLOSURE OF INVENTION

Therefore, it is the principal object of the present invention to provide new and improved security system and method of using it, to help limit access to secured or protected areas to authorized personnel only.

Another object of the present invention is to provide such a new and improved security system, which prevents or at least greatly reduces the possibility of an unauthorized person following an authorized person into the secured or protected area.

Briefly, the above and further objects of the present invention are realized by providing a new and improved security system for controlling access to a secured or protected area and a method of using it.

The security method and apparatus relates to a latching mechanism which is adapted for use with a closure disposed on a vestibule. The closure is used to seal or close off a passageway or entrance between the vestibule and a protected or secured area. A security unit generates a signal which drives the latching mechanism from a latched to an unlatched position. The mechanism is unlatched whenever the vestibule is sealed, and the weight of the person within the vestibule, compares with a predetermined weight value. A weight sensing mechanism senses the weight of a person disposed within the vestibule, so that two persons within the vestibule would cause the weight therewithin to prevent the mechanism to be unlatched. Therefore, only the authorized person may enter the protected area.

The method of using the system includes using a vestibule area for access to a protected area. The vestibule has a passageway to the secured or protected area that has a closure for enabling ingress and egress into and out of the protected area whenever the closure is opened. The latching mechanism connected to the closure permits the closures to be latched in a closed or sealed position, thereby preventing access to the secured or protected area. Conversely, the closure may be unlatched, thereby permitting the closure to be moved by a person in the sealed vestibule area so access may be gained to the secured or protected area.

An authorized person from a remote or otherwise secured area, sets a security device to a predetermined weight setting that approximates the weight of an authorized person. A person then enters the vestibule area through a security door from an unprotected or general access area. When the person enters the vestibule area, he or she locks the security door. When the security door is locked, a scale with a sensing mechanism is activated and determines the weight of the person in the vestibule area. In one form of the invention, a signal indicative of the weight of the person is sent to an electronic access control circuit which generates an access control signal for releasing the latching mechanism if the weight of the person or persons disposed within the vestibule area approximates a predetermined weight previously set in the access control circuitry.

BRIEF DESCRIPTION OF DRAWINGS

The above mentioned and other objects and features of this invention and the manner of attaining them will become apparent, and the invention itself will be best understood by reference to the following description of the embodiments of the invention in conjunction with the accompanying drawings, wherein:

FIG. 3 is a pictorial view of a double door vestibule for use with a security system, which is constructed in accordance with the present invention showing another technique for sensing the weight distributed across the floor of the vestibule, and showing one of the security doors a common access area;

FIG. 3B is a sectional, fragmentary, partially diagramatic view of the vestibule of FIG. 3;

BEST MODE FOR CARRYING OUT THE INVENTION

Figure 1:
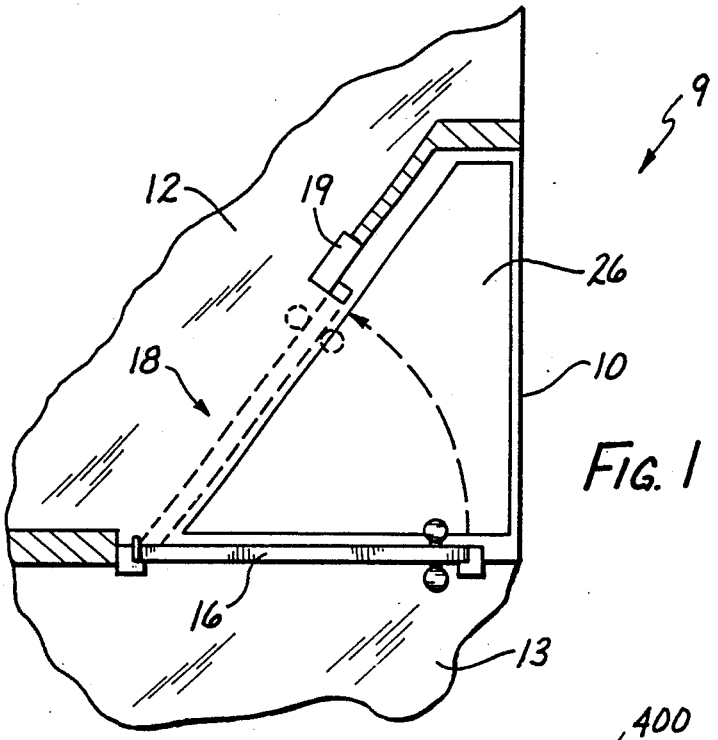
FIG. 1 a top plan view of a single door vestibule adapted for use with a security system which is constructed in accordance with the present invention and showing a strain or floor covering.

Referring to the drawings, and more particularly to FIG. 1, there is illustrated a single door vestibule 10 which is adapted for use with a security system 9 which is constructed in accordance with the present invention and which is used with the vestibule 10 to control entry to a protected or security area 12.

Figure 2:
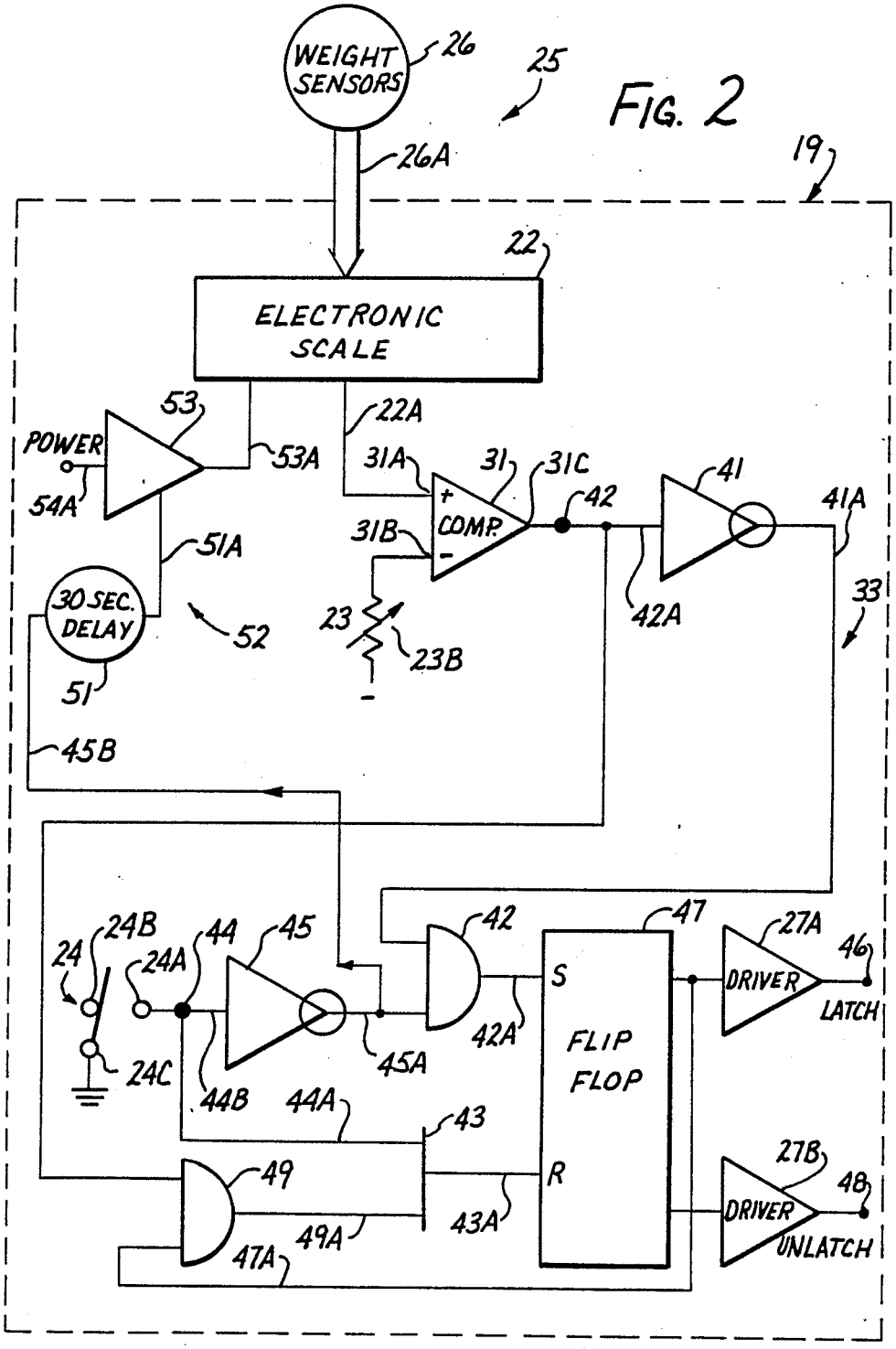
FIG. 2 is a functional block diagram of the security system used with the single door vestibule of FIG. 1 and which is constructed in accordance with the present invention.

Referring now to FIG. 2, the system 9 generally includes an access control unit 19 which controls a conventional latching unit (not shown) adapted for use with a closure 16 disposed on the vestibule 10 to latch the closure 16 in the closed position shown in broken lines across a passageway 18 leading into a protected area 12. The closure 16 is used to seal or close off the passageway or entrance 18 between the vestibule 10 and the protected or security area 12.

As best seen in FIG. 1, the closure 16 is movable from a first closed position sealing entrance to the vestibule 10 from a general access area 13, to a second closed position sealing entrance to the secured or protected area 12, to an open position allowing a person stationed within the vestibule 10 to pass through the passageway or entrance 18 into the protected area 12.

As shown in FIGS. 1 and 2, the system 9 also includes a weight sensing device 26, such as a strain gage mat or floor covering, which is used for sensing the weight of a person standing or otherwise resting on the device 26. The weight sensing device 26 is connected to the access control unit 19 through an electronic scale 22. The weight sensing device 26 and the scale 22 form a weight sensing arrangement 25 (FIG. 2) to generate an electrical signal indicative of the weight of a person or persons confined within the vestibule 10.

The arrangement 25 generates the signal used by the access control unit 19 to activate the latching unit. In this regard, the access control unit 19 generates an enablement signal whenever the entranceway 18 is sealed and the weight of the persons within the vestibule 10, as determined by the electronic scale 22, compares with a predetermined weight value.

For the purpose of determining when the vestibule 10 is closed off to prevent access through the passageway or entrance 18 into the protected area 12, the system 9 also includes a closure switch 24. The closure switch 24 generates a signal indicative that the closure 16 is closed. The closure switch 24 is mounted by conventional mounting techniques adjacent the closure 16 of the vestibule 10 and senses when the closure 16 has been moved to the second closed position blocking the passageway 18.

Considering now the operation of the system 9 in greater detail with respect to FIGS. 1 and 2, a person in the general access area 13, using a key unlocks the closure 16 and obtains access into the vestibule 10. When the person enters the vestibule 10, the closure 16 is moved from a first closed position to an opened position. The moment the closure 16 is opened the access control unit 19 generates a signal which drives and maintains the latching unit in an unlatched position until the closure 16 has been moved from its first closed position sealing access to the vestibule 10 from the general access area 13 to its second closed position sealing access to the secured or protected area 12 from the vestibule 10.

Whenever the person (or persons) within the vestibule 10 permits the closure 16 to seal or close off the passageway 18, the closure switch 24 generates a signal indicative that the closure 16 is in its closed position. When the access control unit 19 receives the closure switch 24 signal, the access control unit 19 generates a signal which is used to activate the latching unit, thus preventing the person entering the vestibule 10 from gaining access to the secured or protected area 12.

After the closure 16 has been latched, the access control unit 19 enables the electronic scale 22. By enabling the scale 22, the access control unit 19 is then able to compare the weight of the person within the vestibule 10 with a predetermined weight value. If the person within the vestibule 10 weighs approximately the same as the predetermined weight value, the access control unit 19 generates an enablement signal which is used to activate the latching unit for unlatching the closure 16, thus permitting the person within the vestibule 10 to obtain access to the secured area 12 through the passageway 18.

Considering now the access control unit 19 in greater detail with reference to FIGS. 1 and 2, the access control unit 19 consists of the electronic scale 22, a controlled power source 52 for supplying power to the electronic scale 22, a comparator 31 connected to the electronic scale 22 and an adjustable reference level circuit 23 for comparing the signal generated by the electronic scale 22 with the signal generated by the reference level circuit 23, a pair of relay drivers 27A and 27B connected to the latching unit by an electrical cable (not shown) and logic control circuitry shown generally at 33 responsive to the comparator 31 and the closure switch 24 for activating and deactivating the relay drivers 27A and 27B based on certain predetermined conditions.

Considering now the comparator 31 in greater detail with reference to FIG. 2, the comparator 31 has a positive and negative input terminal shown at 31A and 31B, respectively. The positive terminal 31A is connected via a cable 22A to the electronic scale 22. The negative terminal 31B is connected to output of the adjustable reference level circuit 23 via an electrical connection 23A. The output of the comparator 31 is connected to the input terminal 42 of the logic control circuitry 33 via a connector 31C.

Considering now the adjustable reference level circuit 23 in greater detail with reference to FIG. 2, the adjustable reference level includes conventional circuitry to generate a reference level voltage. A control knob 23B enables a user of the system 9 to set the voltage level output of the adjustable reference level 23 to a level that is indicative of the approximate predetermined weight of the person authorized to have access to the secured or protected area 12.

Considering now the operation of the adjustable reference level circuitry 23, a security personnel (not shown) adjusts or sets the adjustable reference level 23 to the approximate predetermined weight of the person authorized to have access to the secured or protected area 12. The authorized person then enters the vestibule 10. Once the authorized personnel enters the vestibule 10, the access control unit 19 latches the closure 16 blocking the entranceway 18. When the closure 16 has been latched, the access control unit 19 enables the electronic scale 22.

Once enabled, the electronic scale 22 will generate a signal on its output that is indicative of the weight of the person standing on the weight sensing device 26. The generated signal is received by the comparator 31 on cable 22A. The comparator 21 compares the output signal of the electronic scale 22 with the output signal of the adjustable reference level on cable 23A. If these signals are approximately equal the output of the comparator 31 generates a positive logical signal.

Considering now the control logic circuitry 33 in greater detail with reference to FIG. 2, the control logic circuit has two input terminals 42 and 44 and two output terminals 46 and 48. Input terminal 42 is connected to the output of the comparator 31 by a connector 31C. Input terminal 44 is connected via connector 44B to a normally opened contact 24A of the closure switch 24. Output terminals 46 and 48 are connected to the cable (not shown) for controlling the latching unit (not shown).

As best seen in FIG. 2, the input terminal 42, is connected to the input of an invertor 41 by connector 42A. The output of invertor 41 will therefore be a positive logical signal until such time as the output signal of comparator 31 is driven positive. It should be understood that a positive output signal from the comparator 31 is indicative of an approximate equivalent value between the output signal of the electronic scale 22 and the output signal of the adjustable reference level circuitry 23. Input terminal 42 is also connected to one of two inputs of a logic gate 49 via connector 42B.

Considering now the invertor 41 in greater detail, the output of invertor 41 is connected via line 41A to one of two inputs to a logic AND gate 50. The other input to the logic AND gate 50 is connected to the output of an invertor 45 via connection 45A.

Considering now the invertor 45 in greater detail, the input to invertor 45 is connected to the input terminal 44. As previously noted, input terminal 44 is connected to the normally open contact 24A of switch 24. As this contact is normally floating (a positive logical signal) the output of invertor 45 is controlled by the switch 24 and will normally be negative until the switch 24 is closed as will be explained hereinafter in greater detail. The output of invertor 45 is also connected to a delay circuit 51 via connector 45B.

Considering now the switch 24 in greater detail with reference to FIG. 2, the switch 24 includes a common contact 24C and a normally closed contact 24B. The common contact 24C is connected to ground which holds the normally closed contact 24B of the switch 24 also at ground. When closure 16 is closed blocking access to the vestibule 10 from the common area 13, the switch 24 is normally closed as shown in FIG. 2. When the closure 16 is moved to block entranceway 18 to the protected area 12, the contact 24C moves to the normally open contact 24A. Thus, when the switch 24 is closed, the contact 24A is driven to ground which thereby enables the output of invertor 45 to go to a positive level. It should therefore be understood that the output of the logic AND gate 42 and the delay circuit 51 can only be enabled to go positive when the closure 16 is moved to its second closed position blocking the entrance 18.

Considering now AND gate 50 in greater detail, the output of AND gate 50 is connected via connector 50A to the set input of a flip flop 47. The set output of flip flop 47 is connected via connector 47A to the driver 27A. Accordingly, whenever flip flop 47 is set the driver 27A drives the latch to latch the closure 16 in a closed position. As previously noted, the other input to the logic AND gate 50 is connected to the output of invertor 41. It should therefore be understood that two conditions must be established before the logic AND gate 42 will be enabled. First, the closure 16 must be moved to the second closed position blocking entrance 18. Second, the output of the comparator 31 must be negative, indicating a non-equivalence between the reference level signal from circuit 23 and the output signal from the electronic scale 22.

Considering now the flip flop 47 in greater detail, the reset input to the flip flop 47 is connected to a logic OR gate 43 via connector 43A. The reset output of flip flop 47 is connected via connector 47B to the driver 27B. The driver 27B controls or drives the unlatch which unlatches the latching unit thereby permitting the closure 16 to be moved back to its initial position blocking access to the vestibule 10 from the common area 13. Thus, whenever the flip flop 47 is reset, the latching unit is unlatched. Conversely, whenever the flip flop 47 is set the latching unit is latched.

Considering now the logic OR gate 43 in greater detail with reference to FIG. 2, the logic OR gate 43 has two inputs. The first input is connected to the input terminal 44 via connector 44A. The second input is connected to the output of a logic AND gate 49 via connector 49A. As the input terminal 44 is connected to the normally open contact 24A of the closure switch 24, it should therefore be understood that the output of logic OR gate 43 will be a positive logic signal, holding flip flop 47 in a reset state so long as the closure 16 has not been moved to its second closed position blocking the passageway 18. Accordingly, driver 27B will be positive, actuating the latching unit so it is unlatched. When the closure 16 is moved to the second closed position blocking the passageway 18, the input terminal 44 is driven to ground thus removing the reset signal to the flipflop 47. Accordingly, when this signal is disabled, an enabling signal to the set input of flip flop 47 via AND gate 42, will be able to set flip flop 47.

Considering again, the logic AND gate 50, the AND gate 50 has two inputs. The first input is connected to the output of invertor 45. As previously discussed, the output of invertor 45 is negative until the closure 16 is moved to a closed position blocking the passageway 18. Once the closure 16 is blocking the passageway 18, the output of invertor 45 is driven positive.

The second input to AND gate 50 is connected to the output of invertor 41. Invertor 41 has its input connected to the output of comparator 31. Therefore, the output of invertor 41 will be positive until the output of comparator 31 generates a positive or enabling signal. As will be discussed hereinafter, the output of the comparator 31 is prevented from generating a positive or enabling signal until 30 seconds after the closure 16 has been moved to its second closed position. Therefore, when the closure 16 is first moved to the second closed position, both inputs to AND gate 50 will be positive thereby setting flip flop 47. When flip flop 47 is set, its set output will cause the drives 27A to activate the latch, latching closure 16 in the closed position. As no clocking signals are utilized in the system, the AND gate 42 will remain positive so long as the comparator 31 does not generate an enablement signal.

Considering now the logic AND gate 49 in greater detail with reference to FIG. 2, one of the inputs to AND gate 49 is connected to the output of comparator 31. Therefore, the output of AND gate 49 is unable to go positive until the output of comparator 31 goes positive. The other input to AND gate 49 is connected to the set output of flip flop 47 via connector 47A. As noted earlier, flip flop 47 was previously set when the closure 16 was moved to its second closed position blocking the passageway 18.

Accordingly, the moment the output of the comparator 31 goes positive the output of AND gate 49 goes positive and the set input signal to flip flop 47 derived through AND gate 42 is disabled. In this condition, flip flop 47 will be reset; i.e. when the output of AND gate 49 goes positive, the output of OR gate 43 will also go positive, thus resetting flip flop 47. When flip flop 47 is reset the unlatch driver 27B is activated and the latch driver 27A is deactivated, thus, unlatching the closure 16. In this manner, the person in the vestibule may move the closure 16 back to its original position blocking the entrance to the general access area 13 thereby gaining access to the secured or protected area 12.

Considering now the controlled power source 52 for supplying power to the electronic scale 22 in greater detail with reference to FIG. 2, the controlled power source 52 includes the delay circuit 51 and a power amplifier 53 that supplies power to the electronic scale 22. Considering now the delay circuit 51 in greater detail with reference to FIG. 2, the input to the delay circuit 51 is connected to the output of invertor 45 via the connection 45B. The delay circuit 51 therefore receives the positive output from invertor 45A and passes the positive signal to its output on connector 51A. This condition will exist only when the closure 16 is moved to its second closed position blocking passageway 18.

The delay circuit 51 is a conventional delay circuit well known in the art and having a thirty second delay. Thus, when the input to delay circuit 51 goes positive, the output of delay circuit will not go positive until thirty seconds thereafter. The purpose of the delay circuit 51 is twofold. Firstly, it assures that the closure 16 will initially be latched when the closure 16 is moved to the closed position. Secondly, as will be explained hereinafter in greater detail, it assures that the electronic scale 22 will not be powered up until after the closure 16 has been latched in the closed position. It should be understood that longer or shorter delay periods could be used with respect to delay circuit 51.

Considering now the output of delay circuit 51 in greater detail with reference to FIG. 2, the output of delay circuit 51 is connected via connector 51A to the power amplifier 53. The power amplifier 53 has its output connected to the electronic scale 22. Power amplifier 53 is controlled by the output signal from the delay circuit 51 and will not produce a power output signal unless the output signal from delay circuit 51 is positive. Thus, the scale 22 will not be powered until the power amplifier 53 is enabled via the delay circuit 51. The power amplifier 53 has its input connected to a convenient power source via connector 54A. All of the aforementioned circuits, the power amplifier 53, and the electronic scale 22 are all conventional and well known in the art.

Considering now the electronic scale 22 in greater detail with reference to FIG. 1, the electronic scale 22 has two inputs. The first input is the power source input from power amplifier 53. The second input is connected to the weight sensing means 26 via a connector 26A. It should be understood that the weight sensing means 26 is conventional and that various forms of weight sensors may be utilized.

Referring now to FIG. 3, there is shown another security system 200, which is also constructed according to the present invention. The system 200 includes an electronically controlled latching unit (not shown) which is adapted for use on a vestibule 211 having two closures such as closures 216 and 221. The first closure 216 is used to seal a first passageway or entrance 218 between the vestibule 211 and a protected or secured area 212. The second closure 221 is used to seal a second passageway or entrance 215 between the vestibule 211 and a general access area 217.

Figure 3A:
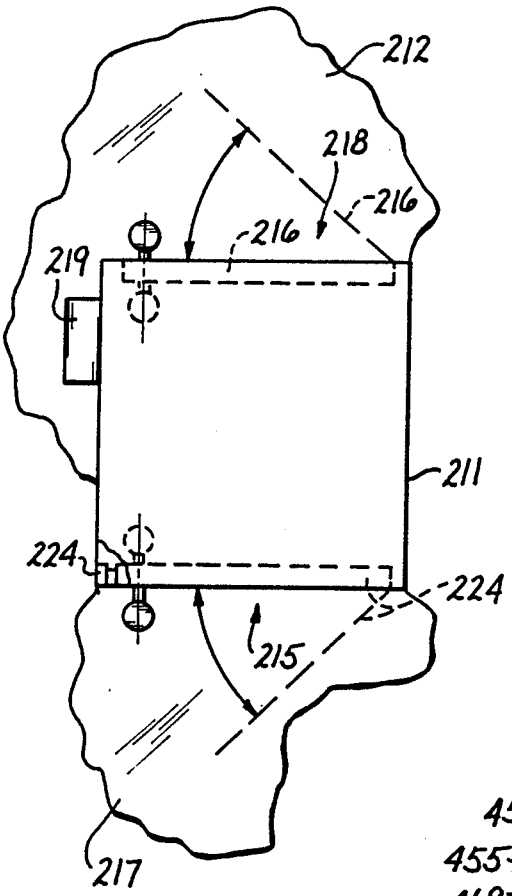
FIG. 3A is a partially broken away top plan view of a two door vestibule of FIG. 3, showing a closure switch for detecting when one of the security doors is opened.

As best seen in FIG. 3A, the closure 216 is movable from a closed position sealing the entrance to the secured or protected area 212, to an open position allowing a person stationed within the vestibule 211 to pass through the passageway or entrance 218 into the protected area 212. Similarly, the closure 221 is moveable from a closed position sealing entrance to the vestibule 211 from a general access area 217 to an open position allowing a person stationed in the general access area 217 to pass through a passageway or entrance 215 into the vestibule 211. An interlock mechanism 230 automatically locks the closure 216 when closure 221 is opened.

As best seen in FIGS. 3 and 3B, the system 200 also includes a weight sensing arrangement 231 for sensing the weight of a person or persons within the vestibule 200. The weight sensing arrangement includes an electronic scale 222 and a movable floor 218 that is mounted in a vertical position within the vestibule 211 by a conventional mounting technique. The floor 218 is supported from beneath by a set of firm resilient support members 226 A, B and C. Support member 226C rests on the electronic scale 222 while the support members 226B and 226C rests on a flat stationary surface beneath the vestibule 211.

The system 200 also includes an access control unit 219 which generates an enablement signal whenever the vestibule 211 is sealed and the weight of a person within the vestibule 211, compares with a predetermined weight value. The access control unit 219 is similar to access control unit 19.

For the purpose of determining when the vestibule 211 is scaled, the system 200 also includes a closure switch 224 for sensing when the vestibule 211 is sealed. It should be understood that the closure switch 224 is used to generate a signal indicative that the closure 221 is closed and the vestibule 211 is sealed preventing access out of the vestibule through either passageways 215 or 218 and that the logic circuitry (not shown) in the access control unit 219 generates the enablement signal to unlatch the closure 216 so a person with the vestibule 211 may open closure 216 to gain access to the protected area 212.

Considering now the operation of the system 200 in greater detail with respect to FIGS. 3A and 3B, a person in the general access area 217, using a key unlocks the closures 221 and obtains access into the vestibule 211. When the person enters the vestibule 211, the closure 221 is moved from a sealed to an opened position and then returned to a sealed position. When the closure 221 is moved to an opened position the access control unit 219 generates a signal which drives the latch so the closure 216 is latched closed. This condition is maintained so long as the closure 221 remains in an opened position.

Whenever the person within the vestibule 211 permits the closure 221 to return to its originally closed position preventing access to the vestibule 211 from the common area 217, the closure switch 224 will generate a signal indicative that the closure 221 is closed, sealing the passageway or entrance 215. When the access control unit 219 sense the vestibule 211 is sealed, the electronic scale 222 is powered up thereby enabling the access control unit 219 to compare the weight of the person within the vestibule 211 with a predetermined weight value. If the person within the vestibule 211 weighs approximately the same as the predetermined weight value, the access control unit 219 generates an enablement signal which is used to drive the unlatch thereby unlatching closure 216 and allowing the person within the vestibule 211 to obtain access to the secured area 212 through passageway 218.

Figure 4:
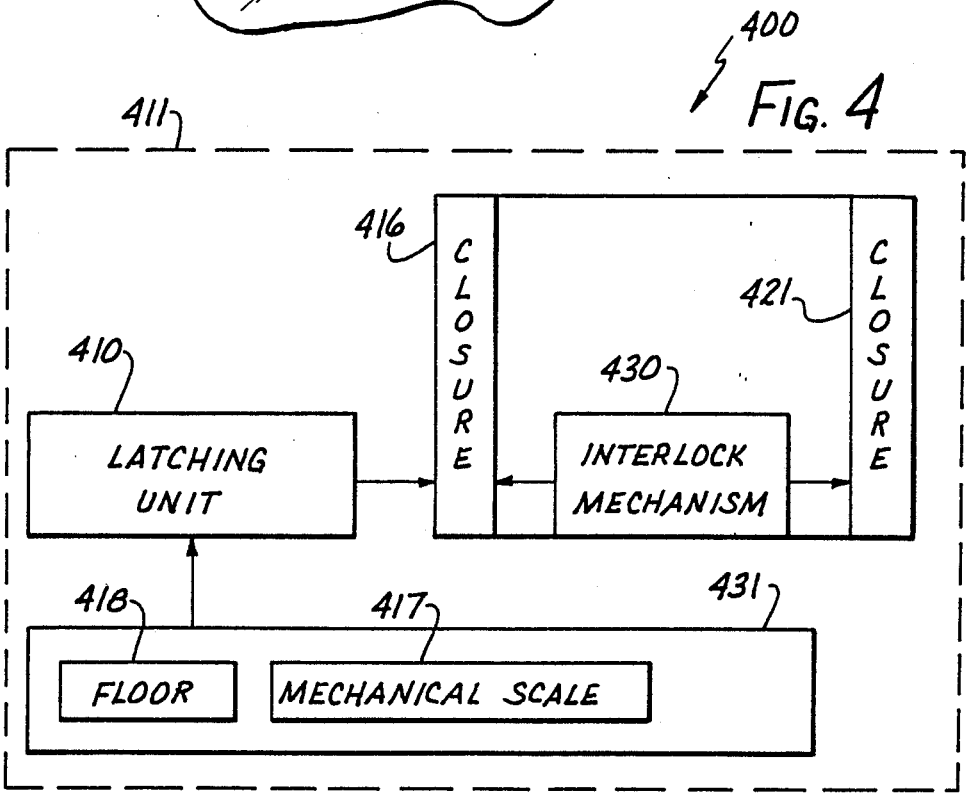
FIG. 4 is a diagramatic view of another vestibule adapted for use with another security system, which is also constructed, according to the present invention.

Referring now to FIG. 4 there is shown another security system 400, which is also constructed according to the present invention, and which does not employ electronic equipment for detecting the weight of the occupants. The system 400 includes a mechanically controlled weight sensing arrangement, shown generally at 431 (FIG. 4C) which is adapted for use on a vestibule 411 having two closures or doors 416 and 421. As shown in FIG. 4A, the first closure 416 is used to close off a first passageway or entrance 418 between the vestibule 411 and a protected or secured area 412. The second closure 421 is used to close off a second passageway or entrance 415 between the vestibule 411 and a general access area 417.

As best seen in FIG. 4A, the closure 416 is movable from a closed position closing off the entrance to the secured or protected area 412, to an opened position permitting a person positioned within the vestibule 411 to pass through the passageway or entrance 418 into the protected area 412. Similarly, the closure 421 is moveable between a closed position closing off the entrance to the vestibule 411 from the general access area, and an opened position permitting a person positioned within the general access area 417 to pass through the passageway or entrance 415 into the vestibule 411. As shown in FIG. 4D, a conventional interlock mechanism 430 mechanically locks the closure 416 when closure 421 is opened.

Figure 4B:
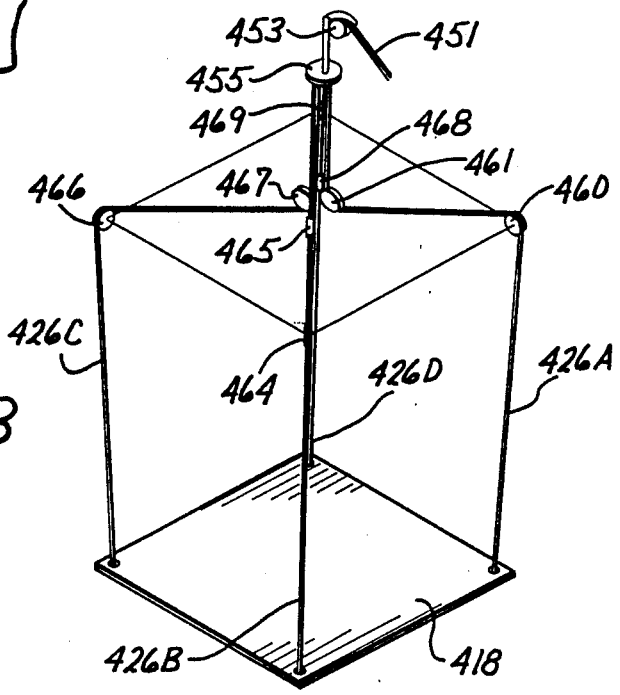
FIG. 4B is a diagramatic view of the system of FIG. 4.

As best seen in FIGS. 4 and 4B, the weight sensing arrangement 431 detects the weight of a person or persons within the vestibule 411. The weight sensing arrangement includes a mechanical scale 417A and a movable floor 418 that is mounted in a vertical position within the vestibule 411 by a conventional mounting technique. The floor 418 is supported from above by a set of cables 426A, 426B, 426C and 426D attached at the four respective corners of the floor 418.

Considering now the operation of the system 400 in greater detail with respect to FIGS. 4A and 4B, a person in the general access area 417, using a key unlocks the closure 421 and obtains access to the vestibule 411. When the person enters the vestibule 411, the closure 421 is moved from a closed or sealed position, to an opened position. When the closure 421 is opened, the interlock mechanism 430 mechanically locks the closure, while closure 421 remains opened.

Whenever the person within the vestibule 411 permits the closure 421 to return to its originally closed position preventing access to the vestibule 411 from the common area 417, the interlock mechanism 430 preventing closure 416 from being opened, is thereby released. It should be understood when the interlock mechanism 430 is released, the person seeking access to the protected area 412 is confined within the interior of the vestibule 411, since both closures are in the closed position.

When the interlock mechanism 430 is released, the weight sensing arrangement 431 determines whether the weight of the person within the vestibule 411 is comparable with a predetermined weight value. If the person within the vestibule 411 weighs approximately the same as the predetermined weight value, the weight sensing arrangement 431 causes a latching unit 410 (FIG. 4C) to unlatch closure 416. Thus, permitting the person within the vestibule 411 to obtain access to the secured area 412 through passageway 418. If an unauthorized person enters the vestibule with the authorized person, then the combined weight of the two persons causes the weight sensing arrangement to latch the closure 416 to prevent entry to the protected area.

Figure 4C:
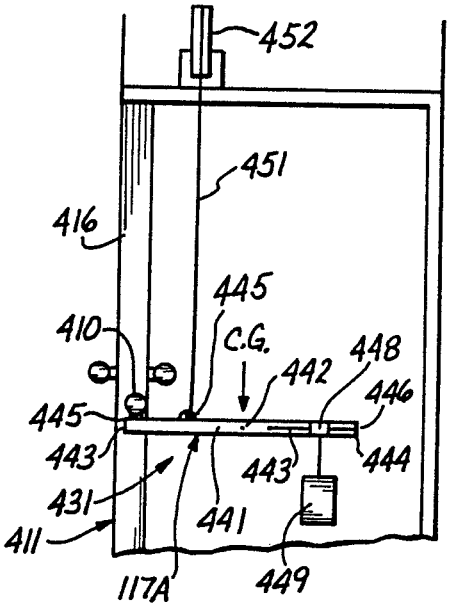
FIG. 4C is an elevational view of the system of FIG. 4.
Figure 4D:
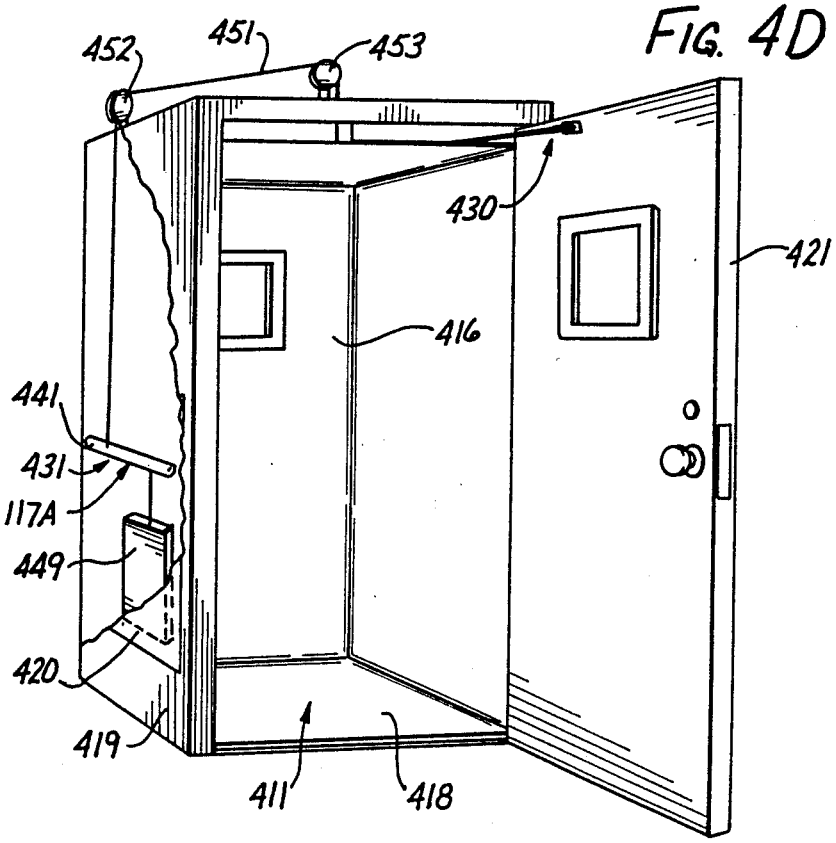
FIG. 4D is a pictorial view of the system of FIG. 4, similar to FIG. 3.
Figure 4A:
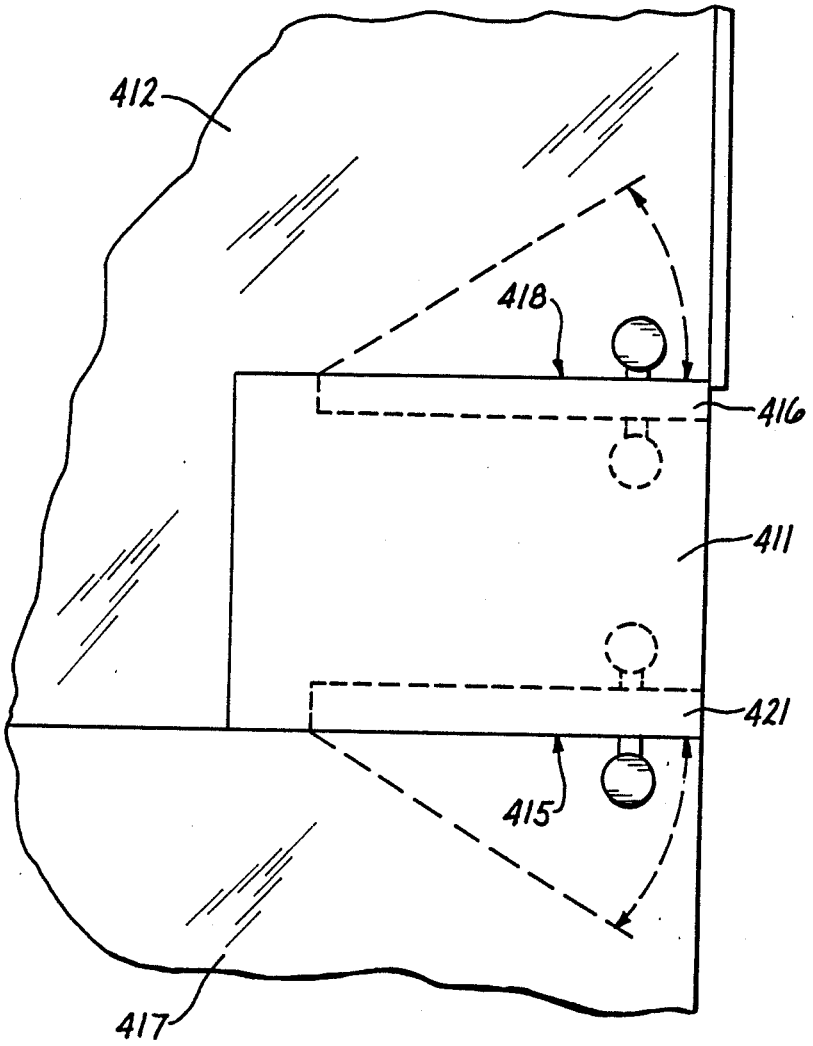
FIG. 4A is a partially diagramatic plan view of the system of FIG. 4.

Considering now the weight sensing arrangement 431 in greater detail with reference to FIGS. 4A, 4B and 4C, the adjustable mechanical scale 417A has a lever arm 441 which is mounted in a wall 419 of the vestibule 411. As shown in FIG. 4D, an access door 420 allows a person within the protected area 412 to adjust the weight setting of the mechanical scale 417A to a predetermined weight value corresponding to the weight of the authorized person, for sensing purposes.

Considering now the mechanical scale 417A in greater detail with reference to FIG. 4C, lever arm 441 pivots about its mounting pivot point 442 which is disposed midway between the opposite ends 443 and 444 of the arm 441.

End 443 of the arm 441 has an upstanding leg or ear portion 445 which mechanically engages the latching unit 410. An eyelet 445 is disposed midway between end 443 and the pivot point 442 and is fixed to the end of a cable 451. A groove 443 transverses along the longitudinal axis of the arm 441 extending from end 444 toward the mounting point 442 to form a track. Mounting slidably within the groove is a support arm 448 which is attached to a hanging counterbalance weight 449.

Considering now the operation of the weight sensing arrangement 431 in greater detail with reference to FIG. 4C, when two persons are disposed within the vestibule 411, the weight 449 exerts a downward force on end 444 of arm 441 forcing end 443 upwardly so that leg 445 engages the latching unit 410 holding it in a latched position. Thus, a person within the vestibule 411 is prevented from gaining access to the protected area 412 through closure 416.

As best seen in FIGS. 4 and 4C, cable 451 attached to lever arm 441 passes over a pair of pulleys 452 and 453 and is connected fixedly at its opposite upper end 454 to a base plate 455. The opposite side of base plate 455 is connected fixedly to the upper ends of cables 426A, B, C, and D, which are attached at their opposite ends to the four respective corners of floor 418 for supporting it from above in a vertically moveable manner. Cable 426A passes over pulleys 460 and 461 respectively. Cable 426B passes over pulleys 464 and 465 respectively. Cable 426C passes over pulleys 466 and 467 respectively. Cable 427D passes over pulleys 468 and 469 respectively. Each of the cables balance and support the floor 418 so that the weight of the person or persons within the vestibule 411 is converted into a force which is, in turn, exerted on cable 451. If the resulting force is of sufficient magnitude to overcome the opposing force by the counterbalance weight 449, then the lever arm 441 rotates in a clockwise direction as viewed in FIG. 4C, until the leg 445 engages the latch 410. In this manner, alternatively, when the force exerted through cable 451 equals the approximate force exerted by weight 449, the lever arm leg 445 is disengaged from the latching unit 410, thus permitting closure 421 to be opened.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A security vestibule for providing controlled access from a common access area to a protected area by an authorized individual comprising:

enclosure means having a floor and a set of stationary walls for helping to control access from one of the areas to the other one of the areas;

means defining a substantially triangularly shaped space within said enclosure means for receiving an individual;

passageway means in said enclosure means for permitting ingress and egress into and out of said space by said individual;

said first passageway and said second passageway converging at one of said stationary walls;

a single common latchable closure;

means for swingably mounting said common latchable closure to said enclosure to permit said closure to move from a first closed position blocking said first passageway to a second closed position blocking said second passageway;

said triangularly shaped space being dimensioned to receive at least one individual but preventing more than one individual from traversing through said space from one of said areas to the other one of said areas when said closure is disposed within said space;

access control means for preventing said closure from moving from one closed position to another closed position;

means for determining the weight of individuals present within said enclosure means to be an approximate equivalent to a predetermined weight of one individual; and latching means responsive to said means for determining weight from enabling said access control means to permit said closure to move from one closed position to the other closed position whereby an individual within said space may egress into one of the areas.

2. A security system for providing controlled access to a protected area by an authorized individual as claimed in claim 1 comprising:

means for determining the weight of individuals present within a predetermined space to be an approximate predetermined weight;

access control means for permitting selective ingress into the protected area from said predetermined space; and latching means responsive to said means for determining weight for enabling said access control means to permit ingress into the protected area by only unauthorized individual having a given weight.

3. A method for controlling access from a common access area to a protected area, comprising:

using enclosure means having a floor and a set of stationary walls thereinbetween for defining a space therewithin for receiving an individual, said enclosure means having a first passageway from the common access area into said space and a second passageway from the protected area into said space;

moving a common closure from a first closed position blocking said first passageway to a second closed position blocking said second passageway;

blocking continuously the path of travel of more than one individual through said enclosure means as said common closure moves from one of said stationary walls blocking said first passageway toward another one of said stationary walls blocking said second passageway;

latching said common closure in the second closed position preventing an individual from gaining access to the protected area;

comparing the weight of an individual or individuals within the space with a predetermined weight that approximates the weight of an authorized individual for an approximate equivalence;

unlatching the closure from the second closed position if there is an approximate equivalence between the individual in the space and the predetermined weight of an authorized person;

moving said common closure from one of said stationary walls blocking the second passageway toward another one of said stationary walls blocking said first passageway to permit the individual within the space to egress from the space into the protected area.

4. The method according to claim 3, further including;

detecting when the closure has moved from the first closed position to the second closed position.

5. A security vestibule according to claim 1, wherein said weight determining means comprises:

a weight sensing device for generating a signal indicative of a weight exerted across a predetermined area within the vestibule; and an electronic scale for converting the generated signal into a reference level signal indicative of the approximate weight exerted across a predetermined area within the vestibule; and an electronic scale for converting the generated signal into a reference level signal indicative of the approximate weight exerted across the predetermined area within the vestibule.

6. A security vestibule according to claim 5, wherein said weight sensing device is a strain gage.

7. A security vestibule according to claim 1 wherein said weight determining means comprises:

a movable floor mounted vertically within said vestibule;

said floor including and being supported from beneath by at least one resilient member;

an electronic scale for generating a reference level signal that approximates the weight of a person standing on said movable floor; and said resilient member resting on said electronic scale for placing said scale in physical contact therewith whereby said scale is able to convert the weight of the person standing on said movable floor into a reference level signal that approximates the weight of said individual.

8. A security system comprising:

enclosure means having a floor and a set of stationary walls for helping to control access from a common access area to a protected area by an authorized individual;

means defining a space within said enclosure means for receiving an individual;

passageway means in said enclosure means for permitting ingress and egress into and out of said space by said individual;

said passageway means including a first passageway from said common access area into said space and a second passageway from said protected area into said space;

latchable closure means for blocking said first passageway and said second passageway;

access control means for enabling said closure means to be moved to an opened position for permitting said individual to traverse from said space into said protected area;

comparing means for determining the equivalence of the weight of an individual within said space with a predetermined weight that approximates the weight of an authorized individual;

weight sensing means for generating a signal that is indicative of the weight of an individual within the vestibule;

means for determining when said closure means is in the closed position blocking the first passageway means;

means for activating said means for comparing when said closure means is in a closed position;

said means for activating having a predetermined delay time period for assuring said closure means is moved to a closed position before enabling said means for comparing; and access control means responsive to said means for determining and to said comparing means for latching and unlatching said latachable closure means to control access to the protected area.

* * * * *